US005687880A

United States Patent [19]

Maas et al.

[11] Patent Number: 5,687,880

[45] Date of Patent: Nov. 18, 1997

[54] CHILD LOCK NOZZLE CAP ASSEMBLY

[75] Inventors: Wilhelmus Johannes Joseph Maas, Someren; Emile Bernard Steijns, Lierop, both of Netherlands

[73] Assignee: AFA Products, Inc., Forest City, N.C.

[21] Appl. No.: 637,200

[22] Filed: Apr. 24, 1996

[51] Int. Cl.[6] ..... B67D 5/33; B67D 5/42

[52] U.S. Cl. ..... 222/153.14; 222/380; 222/383.1

[58] Field of Search ..... 222/153.01, 153.13, 222/153.14, 380, 383.1, 559, 561; 239/333, 394, 478

[56] References Cited

U.S. PATENT DOCUMENTS

| | | | |
|---|---|---|---|
| 3,910,463 | 10/1975 | Reese | 222/153 |
| 3,973,700 | 8/1976 | Schmidt et al. | 222/153 |
| 4,204,614 | 5/1980 | Reeve | 222/383.1 X |
| 4,257,561 | 3/1981 | Mckinney | 222/153.14 X |
| 4,310,105 | 1/1982 | Gach | 222/153 |
| 4,346,821 | 8/1982 | Wesner et al. | 222/153.14 X |
| 4,376,497 | 3/1983 | Mumford | 222/153 |
| 4,424,919 | 1/1984 | Knox et al. | 222/153 |
| 4,516,695 | 5/1985 | Garneau | 222/153.14 |
| 4,773,567 | 9/1988 | Stoody | 222/153 |
| 4,946,074 | 8/1990 | Grogan | 222/153 |
| 5,050,779 | 9/1991 | Knickerbocker | 222/153.14 |
| 5,161,716 | 11/1992 | Knickerbocker | 222/153 |
| 5,169,032 | 12/1992 | Steijns et al. | 222/153 |
| 5,207,359 | 5/1993 | Steijns | 222/383 |
| 5,228,600 | 7/1993 | Steijns et al. | 222/153 |
| 5,299,717 | 4/1994 | Geier | 222/340 |
| 5,482,186 | 1/1996 | Rodden, Jr. | 222/153.07 |
| 5,535,952 | 7/1996 | Tada | 222/153.01 X |

*Primary Examiner*—Andres Kashnikow
*Assistant Examiner*—Kenneth Bomberg
*Attorney, Agent, or Firm*—Thomas R. Vigil

[57] ABSTRACT

The child lock nozzle cap assembly is mounted at the forward end of a body of a trigger sprayer and includes: a nozzle cap; first locking structure associated with the nozzle cap; and, second locking structure associated with a trigger of the trigger sprayer and cooperating with the first locking structure to lock the nozzle cap against rotation until and unless either the first locking structure is moved out of engagement with the second locking structure or the trigger is moved to move the second locking structure out of engagement with the first locking structure.

11 Claims, 3 Drawing Sheets

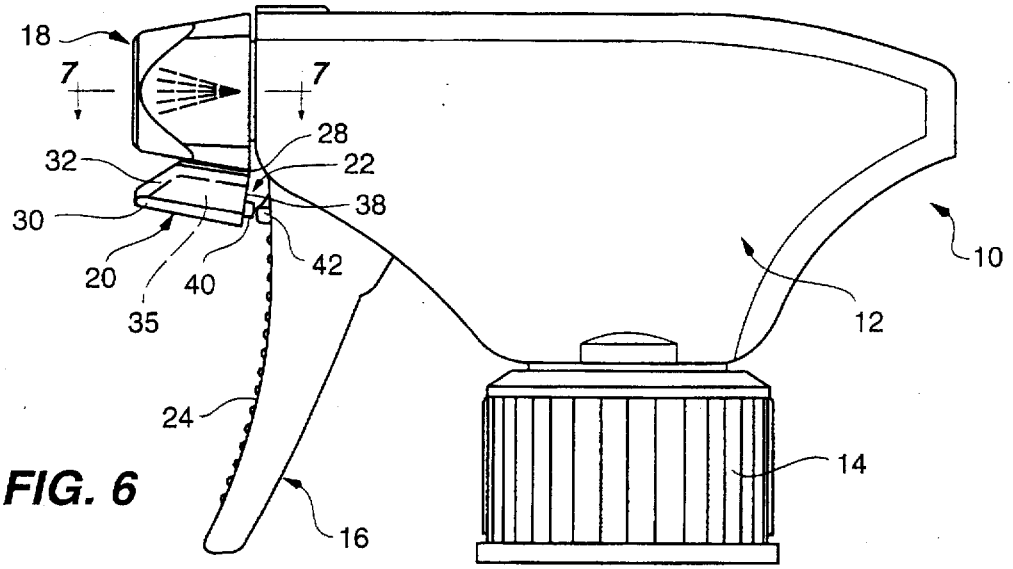
FIG. 6
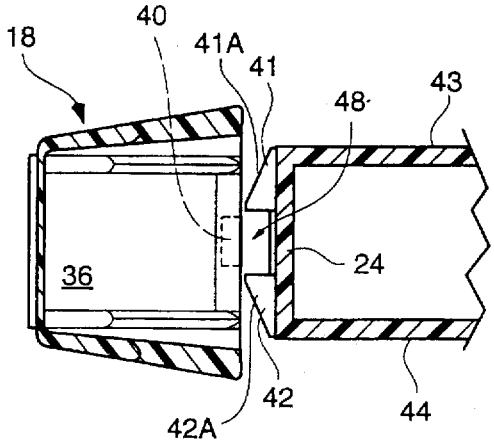
FIG. 7
FIG. 8
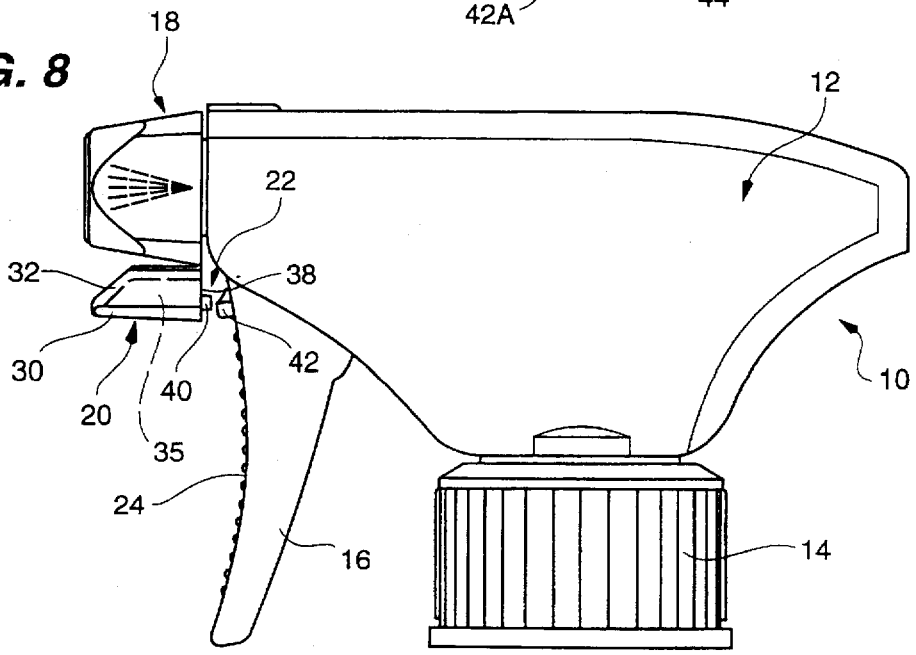

CHILD LOCK NOZZLE CAP ASSEMBLY

BACKGROUND OF THE INVENTION

1. Field of the Invention

The present invention relates to a child lock nozzle cap assembly which is mounted at the forward end of a body of a trigger sprayer and which includes first locking structure associated with a nozzle cap of the assembly which cooperates with second locking structure associated with a trigger of the trigger sprayer. The cooperating first and second locking structures lock the nozzle cap against rotation until and unless either the first locking structure is moved out of engagement with the second locking structure or the trigger is moved to move the second locking structure out of engagement with the first locking structure.

2. Description of the related art including information disclosed under 37 CFR §§ 1.97–1.99

Heretofore, various child resistant nozzle assemblies for trigger sprayers have been proposed. Examples of analogous and non-analogous child-resistant nozzle assemblies are disclosed in the following U.S. Patents:

| U.S. Pat. No. | Patentee |
|---|---|
| 3,910,463 | Reese |
| 3,973,700 | Schmidt et al. |
| 4,204,614 | Reeve |
| 4,257,561 | McKinney |
| 4,310,105 | Gach |
| 4,346,821 | Wesner et al. |
| 4,376,497 | Mumford |
| 4,424,919 | Knox et al. |
| 4,516,695 | Garneau |
| 4,773,567 | Stoody |
| 4,946,074 | Grogan |
| 5,050,779 | Knickerbocher |
| 5,161,716 | Knickerbocher |
| 5,169,032 | Steijns et al. |
| 5,207,359 | Steijns |
| 5,228,600 | Steijns et al. |
| 5,299,717 | Geier |
| 5,482,186 | Rodden, Jr. |

The Wesner et al. U.S. Pat. No. 4,346,821 discloses a nozzle overcap mounted on a nose bushing of a trigger sprayer body. Extending from and below the overcap is an actuating tab. At the lower end of the tab is a tooth-like detent that engages in a slot in the upper portion of a front wall of a trigger. Engagement of the detent in the slot prevents rotation of the overcap until the trigger is depressed slightly to move the slot away from the detent.

The Garneau U.S. Pat. No. 4,516,695 discloses a child resistant nozzle assembly including a flexible lever that depends from a nose bushing and which has a forwardly extending shoulder adapted to engage the inner bottom wall surface at the rear of a nozzle cap to prevent rotation of the nozzle cap. The lever is positioned adjacent the front wall of a trigger. To unlock the nozzle cap, one engages the lever and moves the lever and trigger together slightly inwardly to move the shoulder out of the cap, allowing the cap to be rotated.

SUMMARY OF THE INVENTION

According to the present invention there is provided a child lock nozzle cap assembly which is mounted at the forward end of a body of a trigger sprayer and which includes: a nozzle cap; first locking structure associated with the nozzle cap; and, second locking structure associated with a trigger of the trigger sprayer and cooperating with the first locking structure to lock the nozzle cap against rotation until and unless either the first locking structure is moved out of engagement with the second locking structure or the trigger is moved to move the second locking structure out of engagement with the first locking structure the first locking structure including structure depending from said nozzle cap which is movable upwardly toward the nozzle cap to move a detent carried by the structure forwardly away from the trigger, and the second locking structure including a detent receiving recess on the front of the trigger for receiving the detent.

BRIEF DESCRIPTION OF THE DRAWINGS

FIG. 6 is a side elevational view of the nozzle cap and trigger, similar to the view shown in FIG. 1, but showing the first locking structure moved (squeezed) upwardly to disengage the rearwardly extending locking projection of the first locking structure from the recess formed by the second locking structure to permit rotation of the nozzle cap.

FIG. 7 is a generally horizontal, sectional view through the nozzle and trigger, with portions of the trigger broken away, is taken along line 7—7 of FIG. 6 and shows the rearwardly extending projection disengaged from the recess of the second locking structure by reason of the first locking structure being pivoted (squeezed) upwardly toward the nozzle cap.

FIG. 8 is a side elevational view of the nozzle cap and trigger, similar to the view shown in FIG. 6, but showing the trigger moved (squeezed) inwardly to disengage the second locking structure from the projection extending rearwardly from the first locking structure to permit rotation of the nozzle cap.

DESCRIPTION OF THE PREFERRED EMBODIMENT

Figure 1:
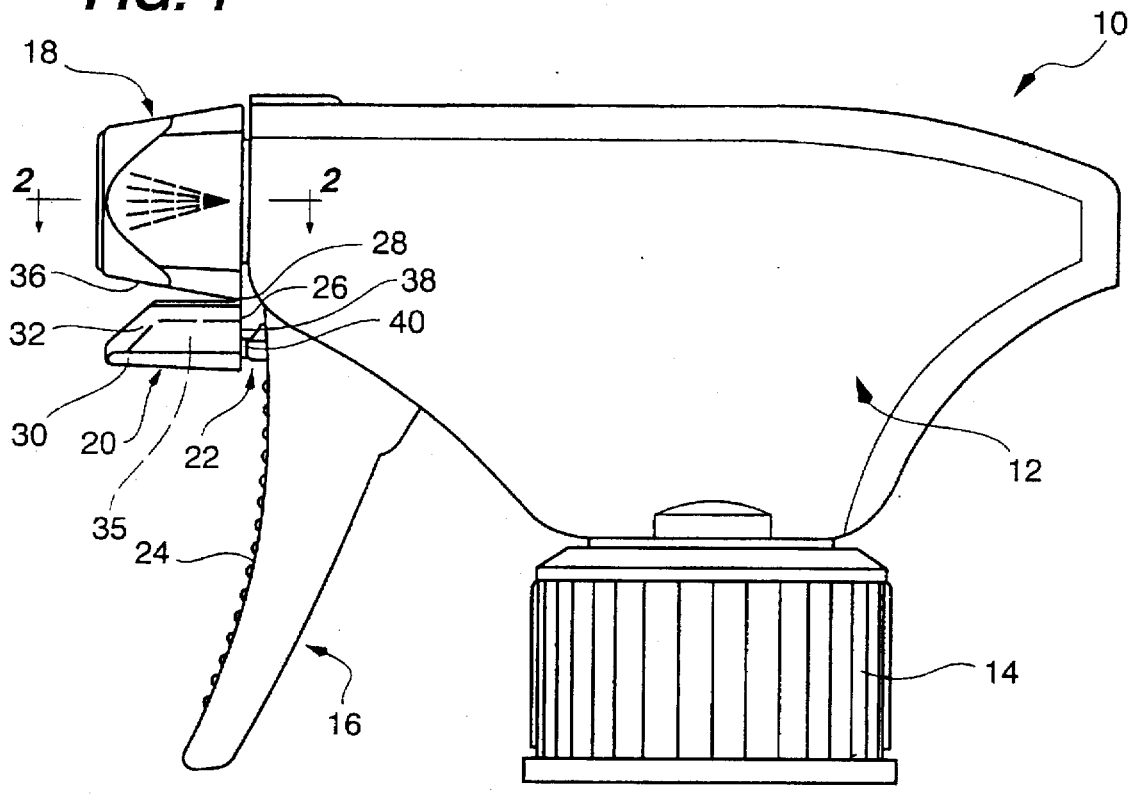
FIG. 1 is a side elevational view of a trigger sprayer having a child lock nozzle cap assembly constructed according to the teachings of the present invention and shows a first lock-unlock structure hingedly connected to the bottom rear edge of a generally square in cross-section nozzle cap and having a rearwardly extending projection which is received in a recess in a second lock-unlock structure on the front of the trigger of the trigger sprayer.

Referring now to the drawings in greater detail, there is illustrated in FIG. 1 a side elevational view of a trigger sprayer 10 comprising a body shroud 12 mounted above a bottle cap 14, a trigger 16 pivotally mounted to a trigger sprayer body or to the body shroud 12 and a nozzle cap 18 mounted to a nose bushing (not shown) extending from the body (hidden from view under the body shroud 12) at the front end of the trigger sprayer 10.

According to the teachings of the present invention, a first lock-unlock structure 20 is mounted to the underside of the nozzle cap 18 and cooperates with a second lock-unlock structure 22 on a front wall 24 of the trigger 16.

Figure 3:
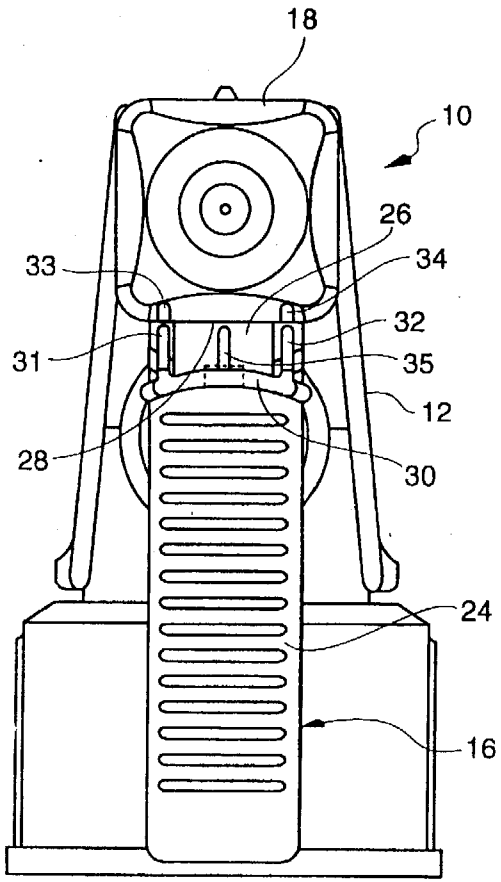
FIG. 3 is a front elevational view of the nozzle cap shown in FIG. 1 and shows the lock position of the nozzle cap with the first locking structure engaging the second locking structure to prevent rotation of the nozzle cap.

As best shown in FIG. 3, the nozzle cap 18 is generally square in shape. The locking structure 20 includes a generally rectangular flange 26 that is hingedly connected to a lower rear edge 28 (FIG. 1) of the nozzle cap 18 and extends downwardly to a forwardly extending tab or lip 30 which is generally rectangular in shape and which has a slightly arcuate shape from side to side (FIG. 3) to facilitate engaging the tab 30 with a finger or thumb.

As shown, first and second spaced apart ribs or flanges 31 and 32 extend upwardly from the tab or lip 30 and are adapted to seat in opposing, spaced apart longitudinal grooves 33 and 34 formed in a lower wall 36 of the nozzle cap 18.

A reinforcing rib 35 is provided on the front side of the flange 26 between the ribs 31 and 32 and extends forwardly from the flange 26 as shown in FIG. 1 and is integral with the flange 26 and the lip 30. The rib 35 controls stress in the hinge 28 so that the plastic material in the area of the hinge 28 is not over stressed when the lip 30 is moved upwardly and pushed up against the nozzle cap 18 and assures a controlled return of the lip 30 to its at rest position after the lip 30 had been moved upwardly and pushed up against the nozzle cap 18.

On a rear surface 38 of the flange 26, is a rearwardly extending projection 40 which can be generally rectangular in cross-section.

Figure 2:
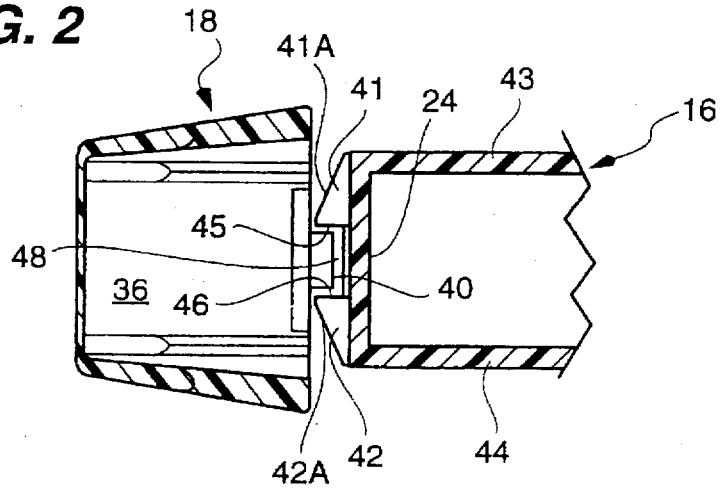
FIG. 2 is a generally horizontal, sectional view through the nozzle and trigger, with portions of the trigger broken away, is taken along line 2—2 of FIG. 1 and shows the rearwardly extending projection of the first locking structure received in the recess defined between two laterally extending ribs of the second locking structure on the front wall of a trigger for locking the nozzle cap against rotation.

As shown in FIGS. 1, 2 and 3, the second locking structure 22 is defined by first and second, laterally extending ribs 41 and 42 on the front wall 24 of the trigger 16. Each of the ribs 41, 42 extends laterally inwardly from one sidewall 43 or 44 part way across the front wall 24 of the trigger 16. Each rib 41, 42 also extends forwardly of the trigger sprayer so as to have a triangular shape as shown in FIG. 2 and have, in particular, a front ramp surface **41*a* or 42*a* to facilitate smooth sliding movement of the project over the ramp shaped ribs 41 or 42 and into a recess or slot 48. Each rib 41, 42 extends approximately one-third of the width of the trigger 16 to a rib end surface 45, 46, respectively, thereby to form the recess 48 therebetween for receiving the projection 40**.

In the at rest position shown in FIGS. 1, 2 and 3, attempted rotation of the nozzle cap 18 will cause one of the sides of the projection to engage and be stopped by one of the rib end surfaces 45 or 46 of one of the ribs 41 or 42.

To unlock the nozzle cap so that it can be rotated, one will either deflect or pivot the first locking structure 20 upwardly to move the projection 40 out of the recess 48 as shown in FIGS. 6 and 7 or move the trigger 16 slightly rearwardly to disengage the second locking structure 22 from the first locking structure 20 as shown in FIG. 8.

With the child lock nozzle cap assembly of the present invention comprising the first and second locking structures 20 and 22, unlocking of the nozzle cap 18 can be accomplished by squeezing the tab or lip 30 upwardly or squeezing the trigger 16 inwardly or both, depending upon the length of the projection 40 and the extent to which the ribs 41 and 42 extend forwardly from the trigger front wall 24 to define the depth of the recess 48.

Figure 5:
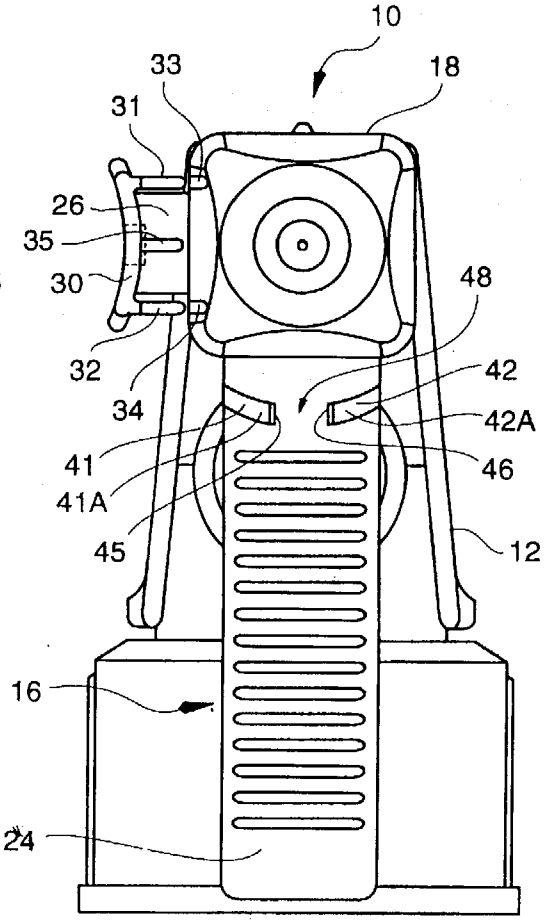
FIG. 5 is a front elevational view of the nozzle cap, similar to the view shown in FIG. 3, but showing the cap in an unlocked rotated (clockwise) position defining a open (spray, stream or foam) position.
Figure 4:
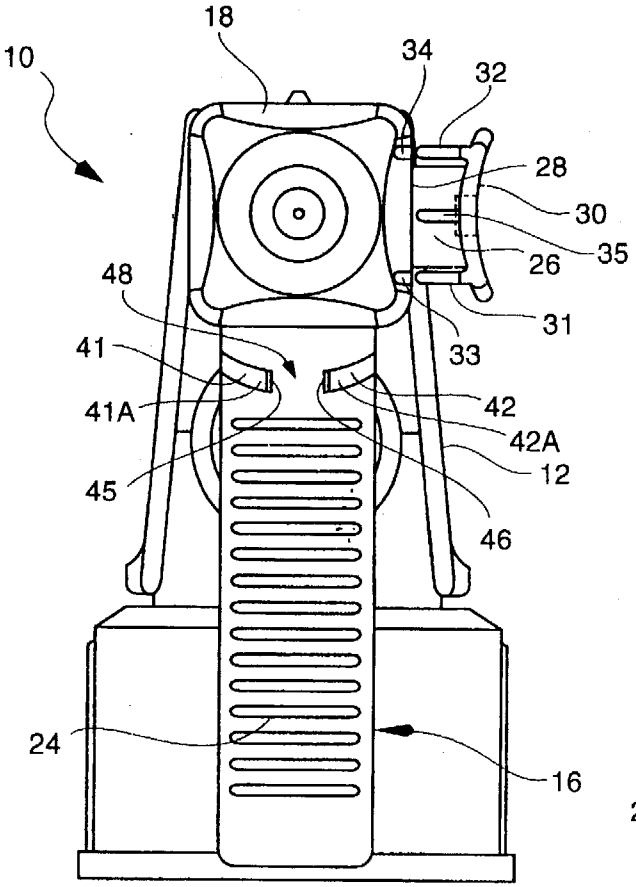
FIG. 4 is a front elevational view of the nozzle cap, similar to the view shown in FIG. 3, but showing the cap in an unlocked rotated (counterclockwise) position defining an open (spray, stream or foam) position.

Furthermore, after the pumping chamber (not shown) and waterway (not shown) leading to the nozzle cap 18 are primed and filled with liquid, it may be difficult to squeeze the trigger 16 to unlock the nozzle cap 18. In this instance, squeezing of the first locking structure 20 would be the best way to unlock the nozzle cap 18 to permit rotation of the nozzle cap 18 counter-clockwise to an open (spray, stream or foam) position shown in FIG. 4 or clockwise to an open (spray, stream or foam) position shown in FIG. 5.

When very caustic liquids are being stored in the container connected to the trigger sprayer 10, it may be desirable to construct the first and second locking structures 20 and 22 so that the depth of the recess 48 or the length of the projection 40 are such that both squeezing of the tab 30 upwardly and squeezing of the trigger 16 inwardly are required to unlock the nozzle cap 18.

From the foregoing description it will be apparent that the child lock nozzle cap assembly of the present invention has a number of advantages, some of which have been described above and others of which are inherent in the invention. Also modifications can be made to the disclosed assembly without departing from the teachings of the invention. Accordingly, the scope of the invention is only to be limited as necessitated by the accompanying claims.

I claim:

1. A child lock nozzle cap assembly which is mounted at the forward end of a body of a trigger sprayer and which includes: a nozzle cap; first locking structure associated with said nozzle cap; and, second locking structure associated with a trigger of the trigger sprayer and cooperating with said first locking structure to lock said nozzle cap against rotation until and unless either said first locking structure is moved out of engagement with said second locking structure or the trigger is moved to move said second locking structure out of engagement with said first locking structure, said first locking structure including structure depending from said nozzle cap which is movable upwardly toward said nozzle cap to move a detent carried by said structure forwardly away from said trigger, and said second locking structure including a detent receiving recess on the front of said trigger for receiving said detent.

2. A child lock nozzle cap assembly which is mounted at the forward end of a body of a trigger sprayer and which includes: a nozzle cap; first locking structure associated with said nozzle cap; and, second locking structure associated with a trigger of the trigger sprayer and cooperating with said first locking structure to lock said nozzle cap against rotation until and unless either said first locking structure is moved out of engagement with said second locking structure or the trigger is moved to move said second locking structure out of engagement with said first locking structure, said second locking structure being defined by first and second opposed laterally extending ribs which extend part way across a front wall of said trigger to end surfaces thereby to form a recess between said end surfaces for receiving said first locking structure.

3. The child lock nozzle cap assembly of claim 2 wherein each of said ribs extend angularly forwardly of the front wall of the trigger so as to have a ramp surface for being slidingly engaged by said first locking structure.

4. The child lock nozzle cap assembly of claim 2 wherein said first locking structure comprises a flange integral with and depending from a lower rear margin of the nozzle cap, a finger manipulatable tab extending forwardly from said flange and a projection extending rearwardly from said flange so as to be received in said recess of said first locking structure.

5. The child lock nozzle cap assembly of claim 4 wherein said flange has a hinge for hingedly connecting said flange to said nozzle cap and has a reinforcing rib extending forwardly from said flange and integral therewith for controlling stress in the material in the area of said hinge when the tab or lip is moved toward the nozzle cap.

6. The child lock nozzle cap assembly of claim 4 wherein said first locking structure includes at least one upwardly extending rib and a mating groove in the outer surface of a lower sidewall of the nozzle cap.

7. The child lock nozzle cap assembly of claim 4 wherein said first locking structure includes two spaced apart ribs extending upwardly from the tab and two spaced apart grooves in the outer surface of a lower sidewall of the nozzle cap.

8. The child lock nozzle cap assembly of claim 4 wherein said tab or lip has a generally arcuate shape extending in a lateral direction of the trigger sprayer to facilitate gripping of the tab or lip with the finger or the thumb.

9. A child lock nozzle cap assembly which is mounted at the forward end of a body of a trigger sprayer and which includes: a nozzle cap; first locking structure associated with said nozzle cap; and, second locking structure associated with a trigger of the trigger sprayer and cooperating with said first locking structure to lock said nozzle cap against rotation until and unless either said first locking structure is moved out of engagement with said second locking structure or the trigger is moved to move said second locking structure out of engagement with said first locking structure, said first and second locking structures being constructed and arranged so that movement of said first locking structure and squeezing of said trigger is required to unlock said nozzle cap to permit rotation of said nozzle cap.

10. A child lock nozzle cap assembly which is mounted at the forward end of a body of a trigger sprayer and which includes: a nozzle cap; first locking structure associated with said nozzle cap; and, second locking structure associated with a trigger of the trigger sprayer and cooperating with said first locking structure to lock said nozzle cap against rotation until and unless either said first locking structure is moved out of engagement with said second locking structure or the trigger is moved to move said second locking structure out of engagement with said first locking structure, said first locking structure comprising a flange integral with and depending from a lower rear margin of the nozzle cap, a finger manipulatable tab extending forwardly from said flange and a projection extending rearwardly from said flange so as to be received in a recess of said first locking structure.

11. The child lock nozzle cap assembly of claim 10 wherein said flange has a hinge for hingedly connecting said flange to said nozzle cap and has a reinforcing rib extending forwardly from said flange and integral therewith for controlling stress in the material in the area of said hinge when the tab is moved toward the nozzle cap.

* * * * *